US008123331B2

(12) United States Patent
Shindo et al.

(10) Patent No.: US 8,123,331 B2
(45) Date of Patent: Feb. 28, 2012

(54) IMAGE FORMING APPARATUS AND INFORMATION RECORDING MEDIUM

(75) Inventors: Tatsuya Shindo, Nagoya (JP); Katsunori Nishida, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 683 days.

(21) Appl. No.: 12/284,627

(22) Filed: Sep. 24, 2008

(65) Prior Publication Data

US 2009/0085956 A1 Apr. 2, 2009

(30) Foreign Application Priority Data

Sep. 28, 2007 (JP) ..... 2007-252871

(51) Int. Cl.
*B41J 2/165* (2006.01)
*B41J 29/38* (2006.01)

(52) U.S. Cl. ..... 347/23; 347/14

(58) Field of Classification Search ..... 347/5, 14, 347/20, 23, 35, 44, 50, 57
See application file for complete search history.

(56) References Cited

U.S. PATENT DOCUMENTS 5,694,156 A * 12/1997 Hoisington et al. ..... 347/7
(Continued)

FOREIGN PATENT DOCUMENTS

JP 2-074353 3/1990
(Continued)

*Primary Examiner* — Stephen Meier
*Assistant Examiner* — Tracey McMillion
(74) *Attorney, Agent, or Firm* — Frommer Lawrence & Haug LLP

(57) ABSTRACT

An ink-jet printer performs formation of an image by jetting an ink from nozzles of an ink-jet head. When a power supply is switched ON after a time measuring section is not capable of measuring time due to the power supply has been switched OFF, then the ink-jet printer outputs to a display section a signal which causes a display control section, provided on a controller, to display a message asking a user whether or not a cleaning operation by a recovery operation control section is to be performed. Accordingly, any unnecessary operation for recovering the jetting function is reduced, solving problems such as waiting time required for performing the operation for recovering the jetting function and that the ink is consumed unnecessarily.

14 Claims, 9 Drawing Sheets

U.S. PATENT DOCUMENTS

| | | | | |
|---|---|---|---|---|
| 5,949,447 | A * | 9/1999 | Arai et al. | 347/23 |
| 2004/0100519 | A1* | 5/2004 | Kikuchi et al. | 347/23 |
| 2004/0165209 | A1* | 8/2004 | Aoki et al. | 358/1.14 |
| 2004/0196488 | A1* | 10/2004 | Tanaka et al. | 358/1.14 |

FOREIGN PATENT DOCUMENTS

| | | |
|---|---|---|
| JP | 7-57551 | 6/1995 |
| JP | 9-267493 | 10/1997 |
| JP | 2007-076050 | 3/2007 |

* cited by examiner

IMAGE FORMING APPARATUS AND INFORMATION RECORDING MEDIUM

CROSS REFERENCE TO RELATED APPLICATION

The present application claims priority from Japanese Patent Application No. 2007-252871, filed on Sep. 28, 2007, the disclosure of which is incorporated herein by reference in its entirety.

BACKGROUND OF THE INVENTION

1. Field of the Invention

The present invention relates to an image forming apparatus which performs an image formation by jetting liquid droplets on to a medium (recording medium), and an information recording medium in which, a computer program which controls the image forming apparatus is recorded.

2. Description of the Related Art

Generally, an image forming apparatus such as an ink-jet printer, has a timer which measures time, and performs a jetting function recovery operation of recovering a jetting function by preventing thickening of ink at a fixed (constant) time interval. In such image forming apparatus, for example, when charging of an internal battery has stopped with a power supply in OFF state, or when the power supply is switched OFF without the internal battery available inside, it is not possible to realize a time elapsed after the previous jetting function recovery operation when the power supply is switched ON again, and it is not possible to carry out the jetting function recovery operation at a predetermined time interval.

Therefore, in many hitherto known image forming apparatuses, when the power supply is switched ON, the jetting function recovery operation is carried out forcibly prior to the image formation (for example, refer to Japanese Examined Patent Application Publication No. H7-57551).

SUMMARY OF THE INVENTION

In this manner, in an apparatus described (disclosed) in Japanese Examined Patent Application Publication No. H7-57551, the jetting function recovery operation is carried out unconditionally whenever the power supply is switched ON. In other words, irrespective of the fact that not much time has elapsed after the previous jetting function recovery operation, the jetting function recovery operation may be carried out. Therefore, when the power supply is switched ON and OFF frequently during the usage, waiting time for the jetting function recovery operation has been forced (the user is forced to wait for a predetermined time for the subsequent jetting function recovery operation), and there has been a problem of the ink being consumed wastefully.

Therefore, an object of the present invention is to provide an image forming apparatus in which, a frequency of carrying out unnecessary jetting function recovery operation is reduced, and an image recording medium in which, a computer program for realizing such image forming apparatus is recorded.

According to a first aspect of the present invention, there is provided an image forming apparatus which is connected to a predetermined display and a predetermined input device, and which performs formation of an image by jetting liquid droplets onto a medium, the image forming apparatus including:

a liquid droplet jetting head which jets the liquid droplets;

a recovery mechanism which recovers a liquid droplet-jetting function, of the liquid droplet jetting head, of jetting the liquid droplets;

an information retention mechanism which retains (stores) predetermined history information; and a control mechanism which controls the recovery mechanism based on the history information retained in the information retention mechanism, and which is connected to the display and the input device;

wherein when a power supply of the image forming apparatus is switched ON and when there is an abnormality (oddity) in the history information, the control mechanism outputs to the display a signal which causes a predetermined message to be displayed on the display.

In the image forming apparatus of the present invention, the information retention mechanism may have a timer which measures a time, and the abnormality in the history information may be a state that the timer is not capable of measuring the time, and the predetermined message may be a message asking a user whether or not an operation for recovering the jetting function by the recovery mechanism is to be performed.

According to the image forming apparatus of the present invention, for example, when there is an abnormality in the information retained by the information retention mechanism, as in a case that the timer (time measuring mechanism) as the information retention mechanism is incapable of measuring the time, the control mechanism causes a predetermined message such as a message asking whether or not to carry out the operation for recovering the jetting function (jetting function recovery operation), to be displayed on the display. Accordingly, the user is capable of selecting as to whether or not to perform the jetting function recovery operation at his or her own will. For example, when the user does not think it is necessary to perform the recovery operation as in a case that the time which could not be measured by the timer is short (is a short time), it is possible to make an arrangement not to perform the jetting function recovery operation. Accordingly, it is possible to solve problems such as a waiting time required for the jetting function recovery operation, and any unnecessary consumption of the liquid for image formation.

In the image forming apparatus of the present invention, when a signal requesting the operation for recovering the jetting function is inputted from the input device, the control mechanism may make the recovery mechanism recover the jetting function. In this manner, for performing the jetting function recovery operation when requested by the user, it is possible to omit any unnecessary jetting function recovery operation, and it is possible to solve problems such as the waiting time for the jetting function recovery operation, and any unnecessary consumption of a liquid for the image formation.

In the image forming apparatus of the present invention, the information retention mechanism may have a timer which measures a time, and the abnormality in the history information may be a state that the timer is not capable of measuring the time, and the predetermined message may be a message asking the user about a duration of time during which the power supply had been switched OFF.

In this case, when the time cannot be measured by the timer, the control mechanism displays a message asking the user about the duration of time period during which the power supply had been switched OFF. Accordingly, based on rough or approximate time during which the power supply had been switched OFF, it is possible to optimally control the jetting function recovery operation of the recovery mechanism, and it is possible to solve the problems such as the waiting time for the jetting function recovery operation and the unnecessary consumption of the liquid for the image formation.

In the image forming apparatus of the present invention, the control mechanism may make a judgment of whether or not the operation for recovering the jetting function by the recovery mechanism is to be performed, based on an extent, of the duration of time, inputted from the input device. In this manner, by not carrying out the jetting function recovery operation when the duration of time period during which the power supply had been switched OFF is short, it is possible to omit the unnecessary jetting function recovery operation, and it is possible to solve the problems such as the waiting time for the jetting function recovery operation and the unnecessary consumption of the liquid for the image formation.

In the image forming apparatus of the present invention, the control mechanism may change an intensity of the jetting function recovery operation by the recovery mechanism, based on the duration of period inputted from the input device. In this case, by changing the intensity (strength) of the jetting function recovery operation based on or depending on to the length of the period during which the power supply had been switched OFF, it is possible to optimally perform the jetting function recovery operation.

The image forming apparatus of the present invention may further include a display section as the display and an input section as the input device. Moreover, the information retention mechanism may have a counter which retains (stores) information about a number of the liquid droplets jetted from the liquid droplet jetting head, and the information retention mechanism may have a counter which retains information of a number of the medium on which the image is formed by the liquid droplet jetting head.

According to a second aspect of the present invention, there is provided an information recording medium which is readable by a computer and which includes a computer program recorded on the information recording medium, the computer program causes the computer to:

make a judgment with respect to an image forming apparatus connected to a predetermined display and a predetermined input device, performing formation of an image by jetting liquid droplets onto a medium, and including a liquid droplet jetting head which jets the liquid droplets, a recovery mechanism which recovers a liquid droplet-jetting function, of the liquid droplet jetting head, of jetting the liquid droplets, and an information retention mechanism which retains predetermined history information; the judgment being about whether or not there is an abnormality in the history information retained by the information retention mechanism when a power supply of the image forming apparatus is switched ON, cause a predetermined message to be displayed on the display when a judgment that there is an abnormality in the history information; and causes the recovery mechanism to recover the liquid droplet-jetting function of the liquid droplet jetting head according to a response, to the message, inputted from the input device.

According to the second aspect of the present invention, when there is an abnormality in the information retained by the information retention mechanism, the computer displays on the display a predetermined message such as a message of as to whether or not the jetting function recovery operation is to be performed. Accordingly, the user can select at his or her own will whether or not the jetting function recovery operation is to be carried out. For example, when the user does not think it is necessary to carry out the recovery operation as in a case that the time which could not be measured by the timer is short (is a short time), it is possible to make an arrangement not to carry out the jetting function recovery operation. Accordingly, it is possible to solve problems such as the waiting time for the jetting function recover operation, and the unnecessary consumption of the liquid for image formation.

DETAILED DESCRIPTION OF THE PREFERRED EMBODIMENTS

First Embodiment

An ink-jet printer as a first embodiment of an image forming apparatus of the present invention will be described below while referring to the accompanying diagrams.

Figure 1:
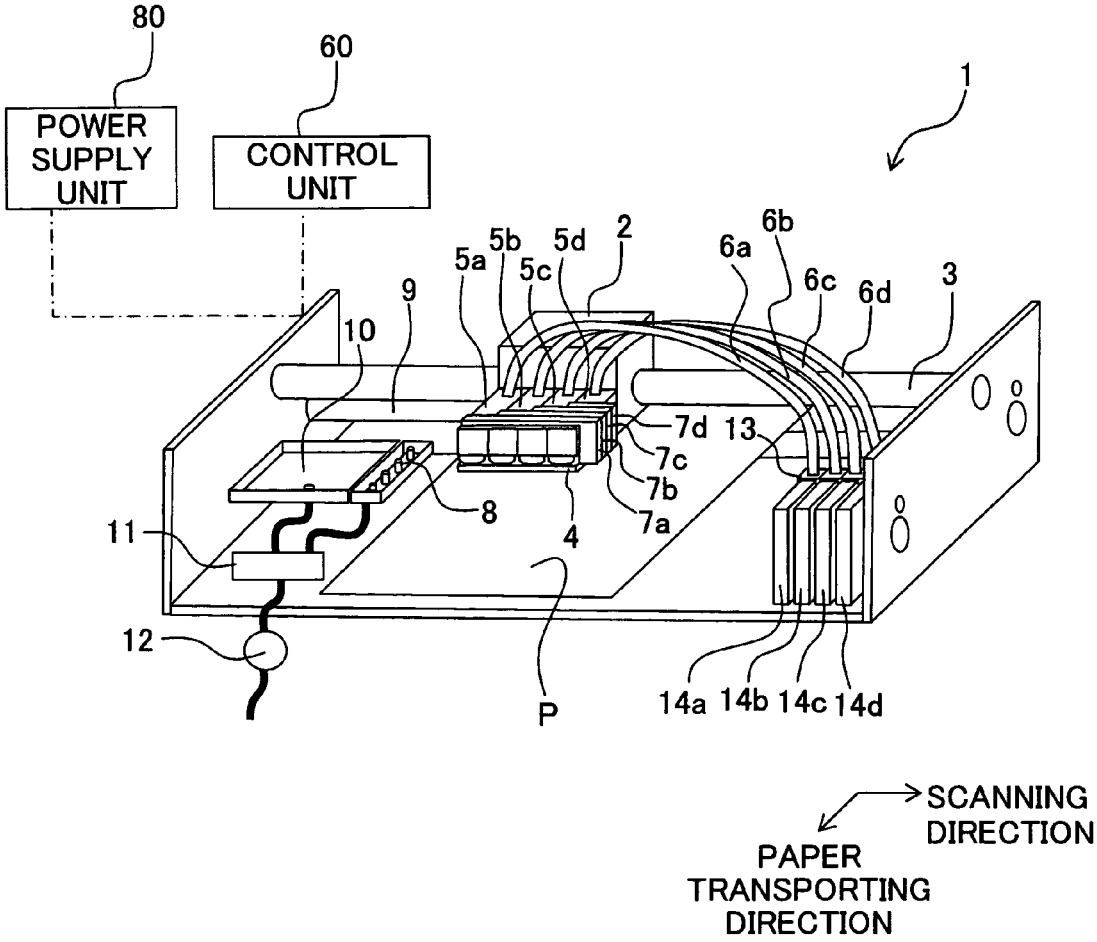
FIG. 1 is a schematic structural view of an ink-jet printer according to the present invention.
Figure 2A:
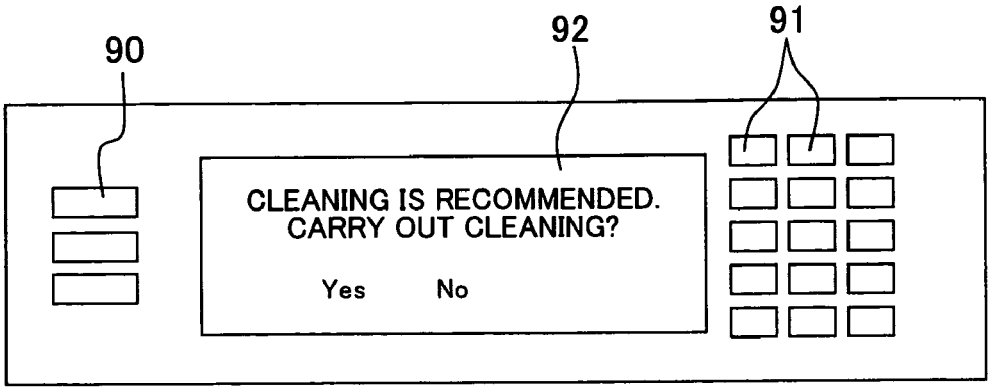
FIG. 2A is a plan view of an operation panel portion of the ink-jet printer in FIG. 1, and FIG. 2B and FIG. 2C are diagrams describing a display function in a display section in the operation panel portion.

FIG. 1 is a schematic structural view of an ink-jet printer according to the first embodiment. As shown in FIG. 1, the ink-jet printer 1 includes mainly a scanning unit which scans by reciprocating a liquid droplet jetting head (ink-jet head) 4, parallel to a paper P which is an image forming medium, a transporting unit which transports a paper P in a direction orthogonal to a scanning direction, and an ink supply unit which supplies to the ink-jet head 4 a liquid (ink) for image formation, and a recovery unit which makes recover a jetting function of the ink-jet head 4. In addition to this, the ink-jet printer 1 includes a controller 60 which controls operations of the abovementioned components, and a power supply unit 80 which supplies an electric power for these operations. Moreover, as shown in FIG. 2, the ink-jet printer 1 includes an input section 91 (input mechanism) such as a key switch, on an operation panel section 90, and a display section 92 (display mechanism) such as a liquid crystal display (board).

The main scanning unit includes a carriage 2 on which, the ink-jet head 4 is mounted (installed), and makes the carriage 2 reciprocate in the scanning direction (left-right direction in FIG. 1) along a guide shaft 3. The ink-jet head 4 holds the carriage 2 such that nozzles 25 formed in a lower surface of the carriage 2 are exposed downward (refer to FIG. 2), and jets an ink from the nozzles 25 toward the paper P while reciprocating in the scanning direction along with the carriage 2.

The ink supply unit has four cartridges 14*a*, 14*b*, 14*c*, and 14*d* (14*a* to 14*d*) installed at a predetermined mounting site (cartridge mounting portion) 13 in ink-jet printer 1 independent of the carriage 2, four ink tanks 5*a*, 5*b*, 5*c*, and 5*d* (5*a* to 5*d*) mounted on the carriage 2, four tubes 6*a*, 6*b*, 6*c*, and 6*d* which connect the ink cartridges 14*a* to 14*d* and the ink tanks 5*a* to 5*d* respectively. Inks of black, yellow, cyan, and magenta colors are filled in the ink cartridges 14*a* to 14*d* respectively. These inks of four colors are supplied from the ink cartridges 14*a* to 14*d* to the four ink tanks 5*a* to 5*d*, via four tubes 6*a* to 6*d*, and are further supplied from the ink tanks 5*a* to 5*d* to the ink-jet head 4.

The transporting unit includes transporting rollers 9 which transport the paper P in the direction orthogonal to the scanning direction of the carriage 2, at a lower position (downward position) of nozzles 25 of the ink-jet head 4.

Figure 4A:
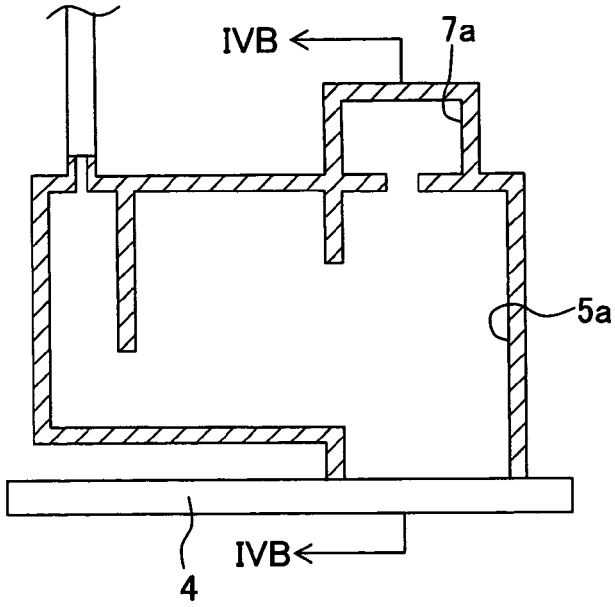
FIG. 4A is a vertical cross-sectional view of a sub-tank portion and the ink-jet head in FIG. 1.
Figure 4B:
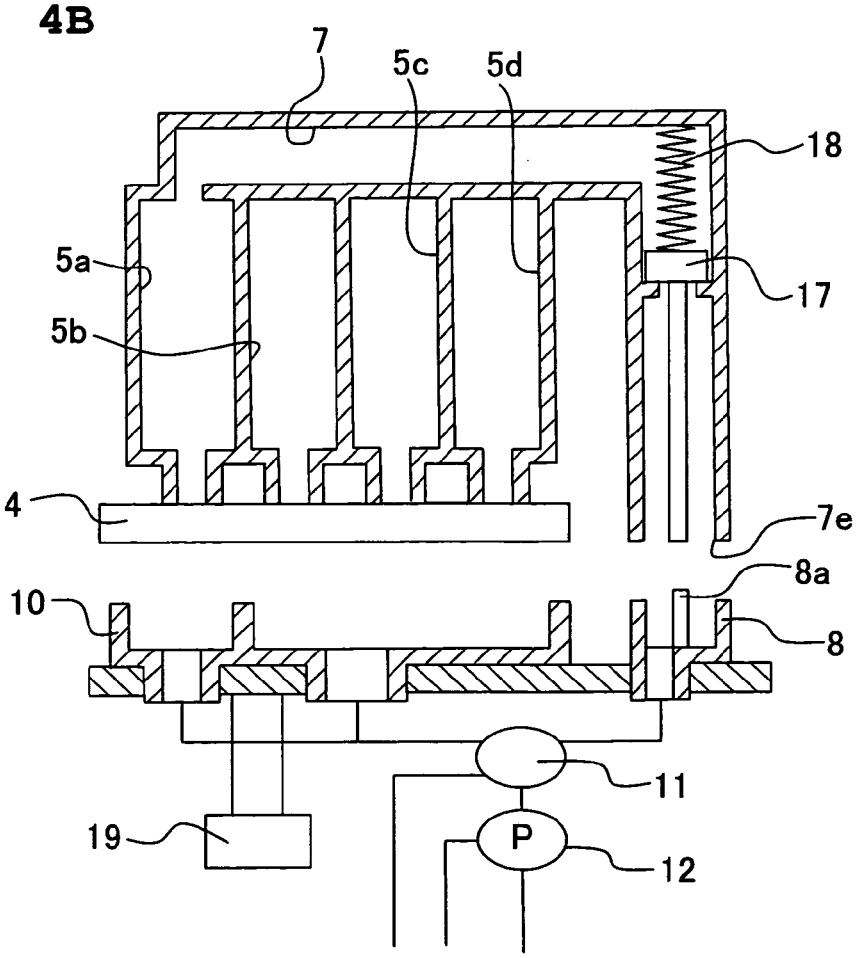
FIG. 4B shows a cross-sectional view taken along a VIB-VIB line in FIG. 4A and a cross-sectional view of a corresponding cap portion.

The recovery unit performs a purge operation, an air discharge operation, and a flushing operation which have hitherto been known. For the air discharge operation, the ink tanks 5*a* to 5*d* are provided with aid discharge channels 7*a*, 7*b*, 7*c*, and 7*d* (7*a* to 7*d*) respectively, as shown in FIG. 4. The air discharge channels 7*a* to 7*d* are extended in a right direction from an upper surface thereof, and are bent downward in a right end portion thereof, at a substantially right angle. A lower end opening 7*e* of the four air discharge channel 7*a* to 7*d*, opens to an outside, at a side of the ink-jet head 4, and each has a valve 17 provided at an interior. The valves 17 close the air discharge channels 7*a* to 7*d* with respect to the outside all the time, by an action of a spring 18.

An air discharge cap 8 and a purge cap 10 are provided on a side of a transporting area (area of transporting) on which the paper P is transported in the ink-jet printer 1. The air discharge cap 8 and the purge cap 10 are movable in a vertical direction by an ascending and descending mechanism 19. When the purge cap 10 moves upward toward the carriage 2 which has moved to a side of the area of transporting of the paper P, the air discharge cap 8 comes in a close contact with the lower end opening 7*e* of the air discharge channels 7*a* to 7*d*, and the purge cap 10 makes a close contact with a lower surface of the ink-jet head 4. A protrusion 8*a* is formed at an interior of the air discharge cap 8. When the air discharge cap 8 is connected to the lower end opening 7*e* of the air discharge channels 7*a* to 7*d*, the protrusion 8*a* pushes up and opens the valve 17, and an upper (portion) space in a sub tank 5 and an inside of the air discharge cap 8 are connected.

The purge cap 10 and the air discharge cap 8 may be moved vertically by a separate ascending and descending mechanism for each. Moreover, the air discharge cap 8 and the protrusion 8*a* therein may be moved vertically by a separate ascending and descending mechanism for each. Furthermore, an arrangement may be made such that the valve 17 inside each of the air discharge channels 7*a* to 7*d* is opened and closed separately.

Each of the air discharge cap 8 and the purge cap 10 are connected to a suction pump 12 via a switching unit 11. The switching unit 11 switches connection and cutting off of the air discharge cap 8, the purge cap 10, and the suction pump 12.

When the air discharge cap 8 is connected to the air discharge channels 7*a* to 7*d*, and the air discharge cap 8 and the suction pump 12 are connected by the switching unit 11, the suction pump 12 is operated. At this time, air in an upper portion inside the ink tanks 5*a* to 5*d* is discharged to the outside from the air discharge channels 7*a* to 7*d*.

Moreover, the lower surface of the ink-jet head 4, in other words the nozzles 25, is covered by the purge cap 10, and the purge cap 10 and the suction pump 12 are connected by the switching unit 11. At this time (In this state), when the suction pump 12 is operated, the ink in the ink-jet head 4 is sucked from the nozzles 25 (suction purge operation).

In the flushing operation, when the carriage 2 has moved to a position at a side of the area of transporting of the recording paper P, by driving the ink-jet head 4 irrespective of the image data, the ink from all the nozzles 25 is jetted to the purge cap 10 or a hitherto known receptacle which is not shown in the diagram. Such flushing operation is carried out for recovering the jetting function of the ink-jet head 4 as it has hitherto been known.

Figure 3:
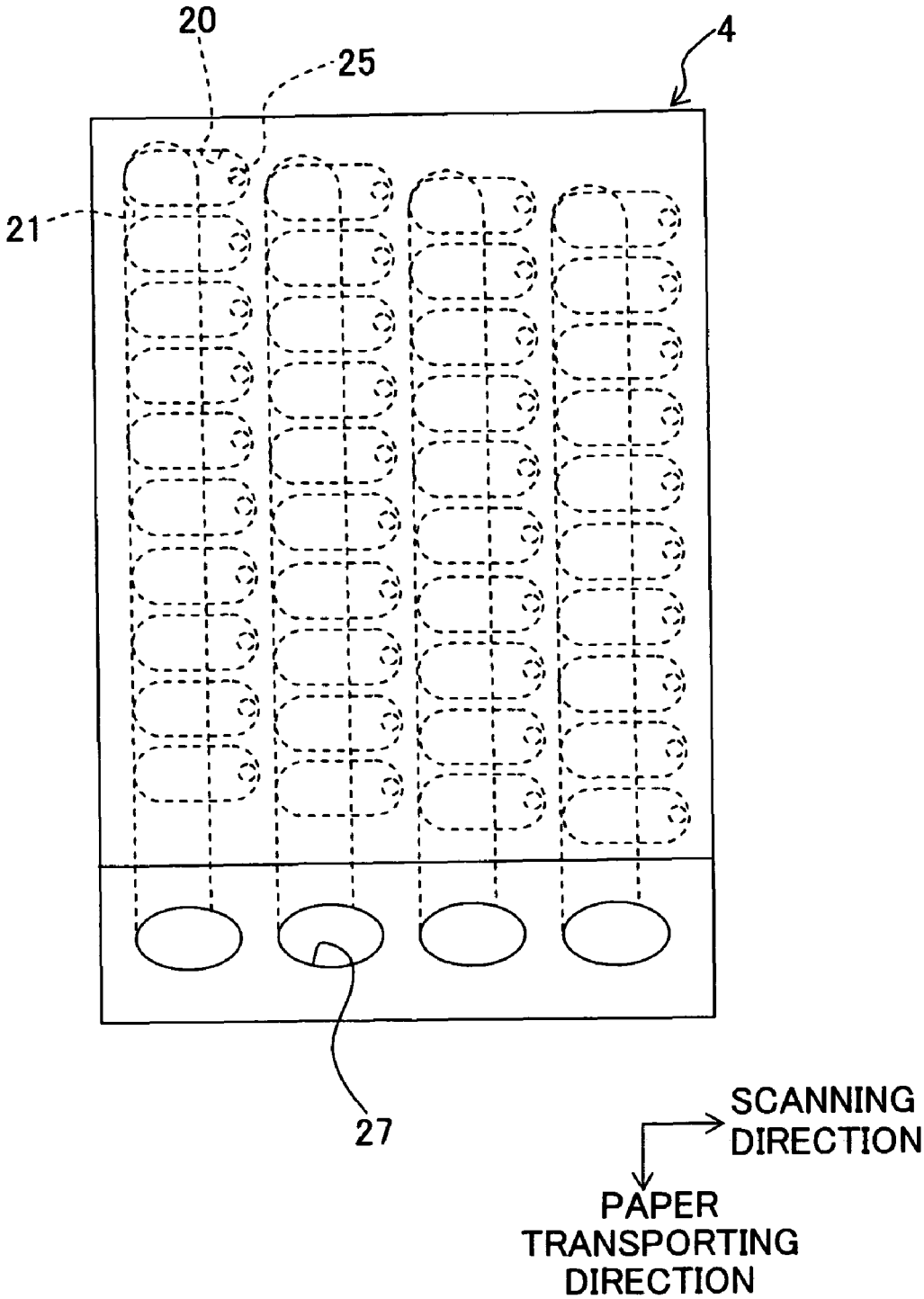
FIG. 3 is a plan view of an ink-jet head.

FIG. 3 is a diagram showing an example of the ink-jet head 4. Similarly as a known ink-jet head, the lower surface of the ink-jet head 4 includes a multiple number of (a plurality of) nozzles 25 facing the recording paper and forming a row for an ink of each of black, yellow, cyan, and magenta colors. The nozzles 25 of each row communicate with a manifold channel 21 provided for each ink (for ink of each color), via a pressure chamber 20. At one end of the manifold channel 21 a supply port 27 which communicates with the sub tank 5 is formed, and the ink which is supplied from the sub tank 5 to the manifold channel 21 is distributed to the pressure chamber 20. When jetting energy is imparted to the ink in the pressure chamber 20, the ink becomes (the ink is converted to) ink droplets and is jetted toward the recording paper from the nozzles 25. As a mechanism for imparting the jetting energy to the ink, it is possible to use a mechanism which uses a deformation of a piezoelectric element, and a mechanism which causes bubbling of ink by a heater.

Figure 5:
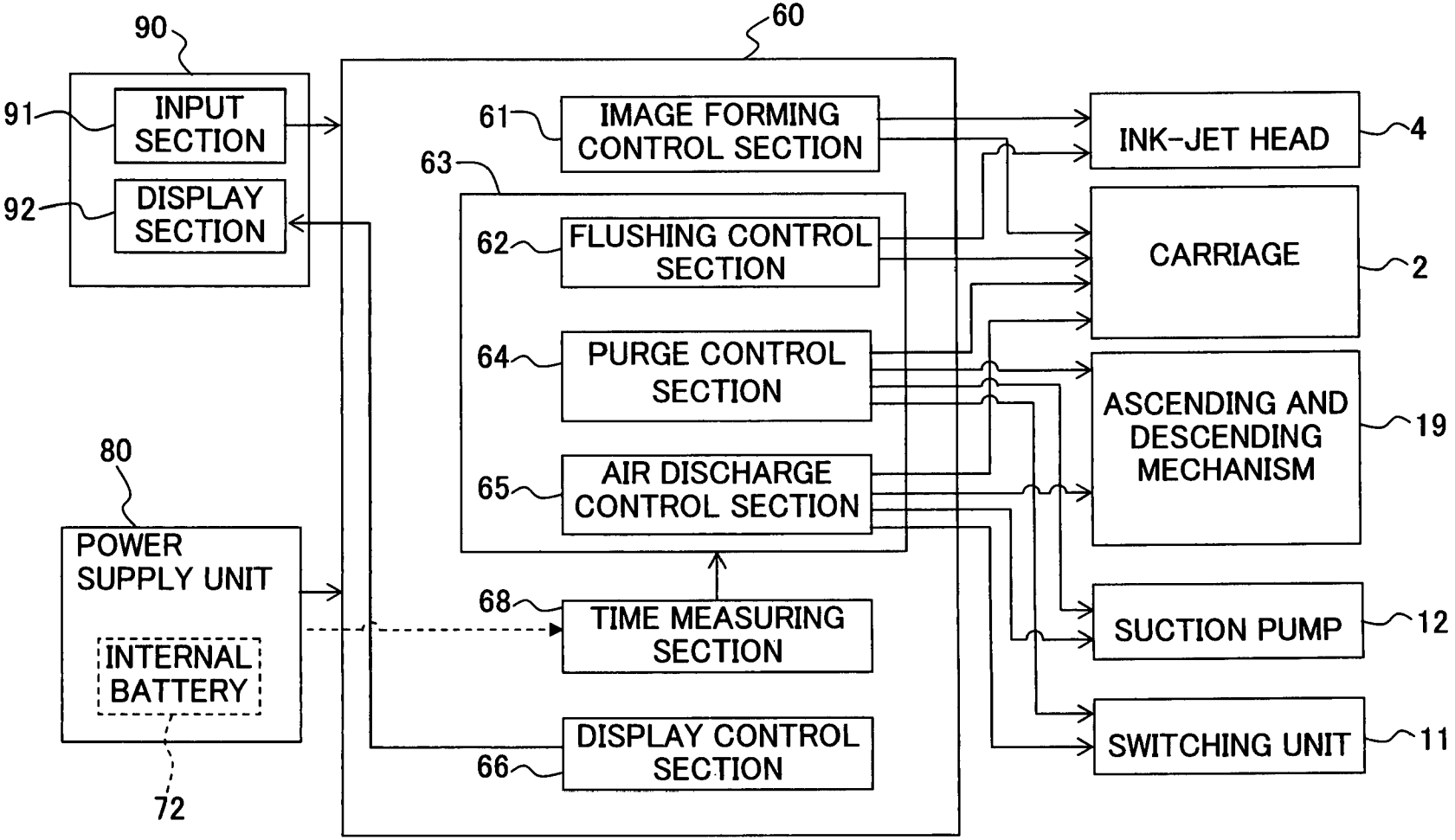
FIG. 5 is a block diagram showing schematically a controller.

Next, the controller 60 (control mechanism) which controls an operation of the ink-jet printer 1 will be described below while referring to FIG. 5. The controller 60 includes components such as a Central Processing Unit (CPU), a Read Only Memory (ROM), and a Random Access Memory (RAM). As shown in FIG. 5, the controller 60 operates (functions) an image forming control section 61, a recovery operation control section 63, a display control section 66, and a time measuring section 68 (time measuring mechanism, timer) as shown in FIG. 5.

At the time of carrying out image formation based on image data input from an external equipment such as a personal computer (PC) 90 and a facsimile, the image forming control section 61 controls an operation of the ink-jet head 4, the main scanning unit, and the transporting unit.

The recovery operation control section 63 is a section which controls a cleaning operation (jetting function recovery operation) of recovering the jetting function of the ink-jet head 4, such as, the purge operation, the air discharge operation, and the flushing operation, and includes a flushing control section 62, a purge control section 64, and an air discharge control section 65.

The flushing control section 62 controls an operation of the ink-jet head 4 and the carriage 2 at the time of carrying out the flushing operation.

The purge control section 64 controls an operation of the carriage 2, the ascending and descending mechanism 19, the switching unit 11, and the suction pump 12 at the time of carrying out the suction purge operation of the purge cap 10.

The air discharge control section 65 controls an operation of the carriage 2, the ascending and descending mechanism 19, the air discharge cap 8, the switching unit 11, and the suction pump 12 at the time of carrying out the air discharge operation of discharging air inside the ink tank 5 by the air discharge cap 8.

The time measuring section 68 measures the time elapsed after each previous cleaning operation (the purge operation, the air discharge operation, and the flushing operation) by the recovery operation control section 63, till the current time, and outputs to the recovery operation control section 63. The recovery operation control section 63 drives the flushing control section 62, the purge control section 64, and the air discharge control section 65 at a predetermined cycle, based on the time measured by the time measuring section 68. When an internal battery 72 has been mounted (installed) in the power supply unit 80, the time measuring section 68 maintains a function of measuring the elapsed time for a certain fixed period by the internal battery 72 even after the power supply is switched OFF by disconnecting from the main power supply, However, thereafter, when the internal battery 72 is depleted, time data which has been measured is deleted (erased), and a state in which the elapsed time cannot be measured is assumed. Consequently, in this case, when the main power supply is connected once again in the fixed period after being disconnected from the main power supply, the time measuring section 68 continues a measuring operation. Moreover, when the internal battery is not mounted (installed) in the power supply unit 80, as the power supply is turned OFF, the data of time measured is deleted (erased) immediately, and it is not possible to measure the elapsed time.

The display control section 66 outputs to the display section 92 a message signal to be displayed on the display section 92 of the operation panel section 90. When the power supply is switched ON, the display control section 66 makes a judgment of an operation status of the time measuring section 68. Here, when the time measuring section 68 is not capable of measuring the time, the display control section 66, by controlling the display section 92, displays on the display section 92 a message asking the user whether or not the cleaning operation is to be carried out. Moreover, the display control section 66, by controlling the display section 92, displays on the display section 92 a message asking the user whether or not the test printing is to be carried out, and whether or not the cleaning operation is to be carried out according to a result of the test printing.

Figure 6A:
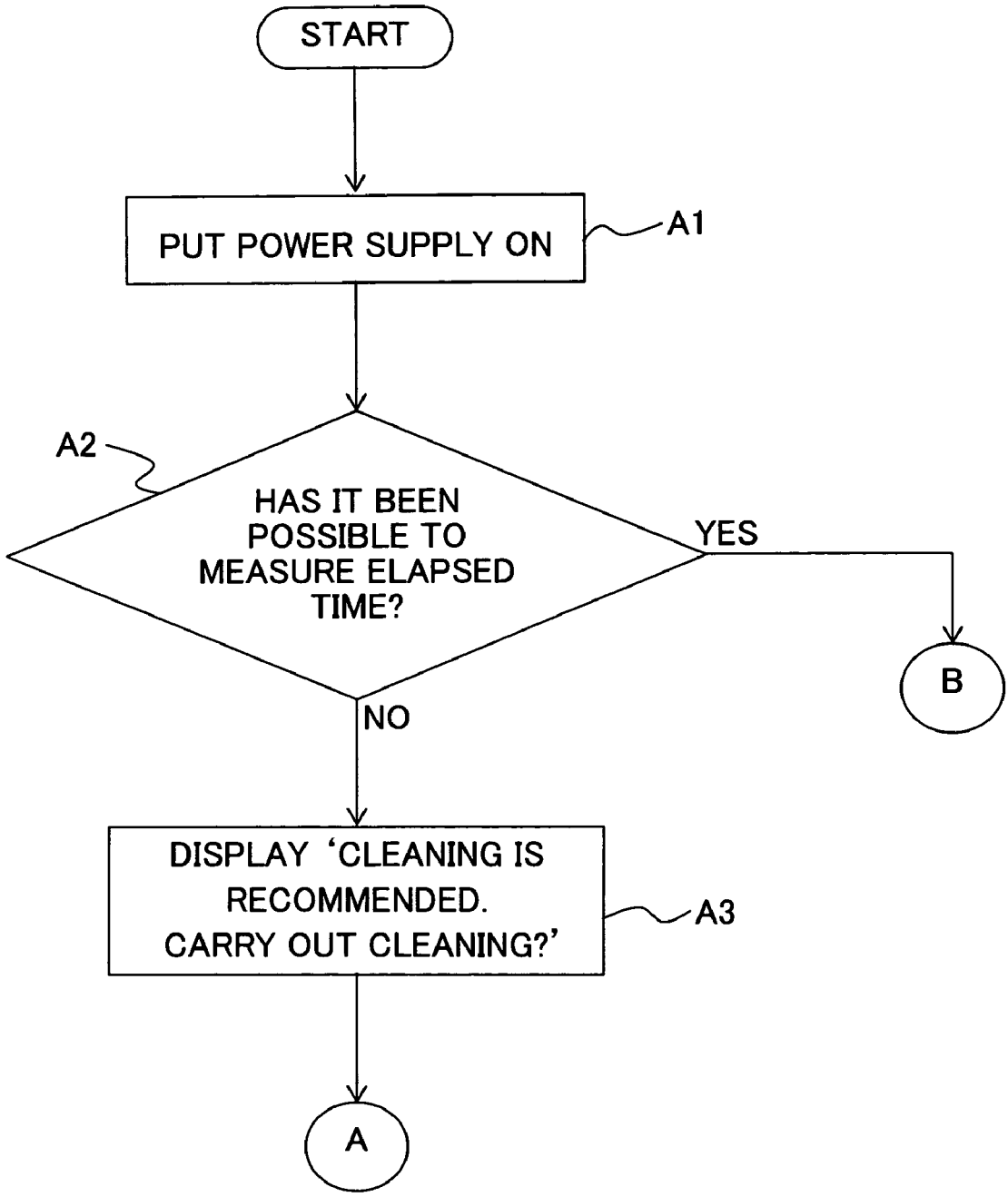
FIGS. 6A and 6B are flowcharts describing a cleaning operation of a first embodiment.
Figure 6B:
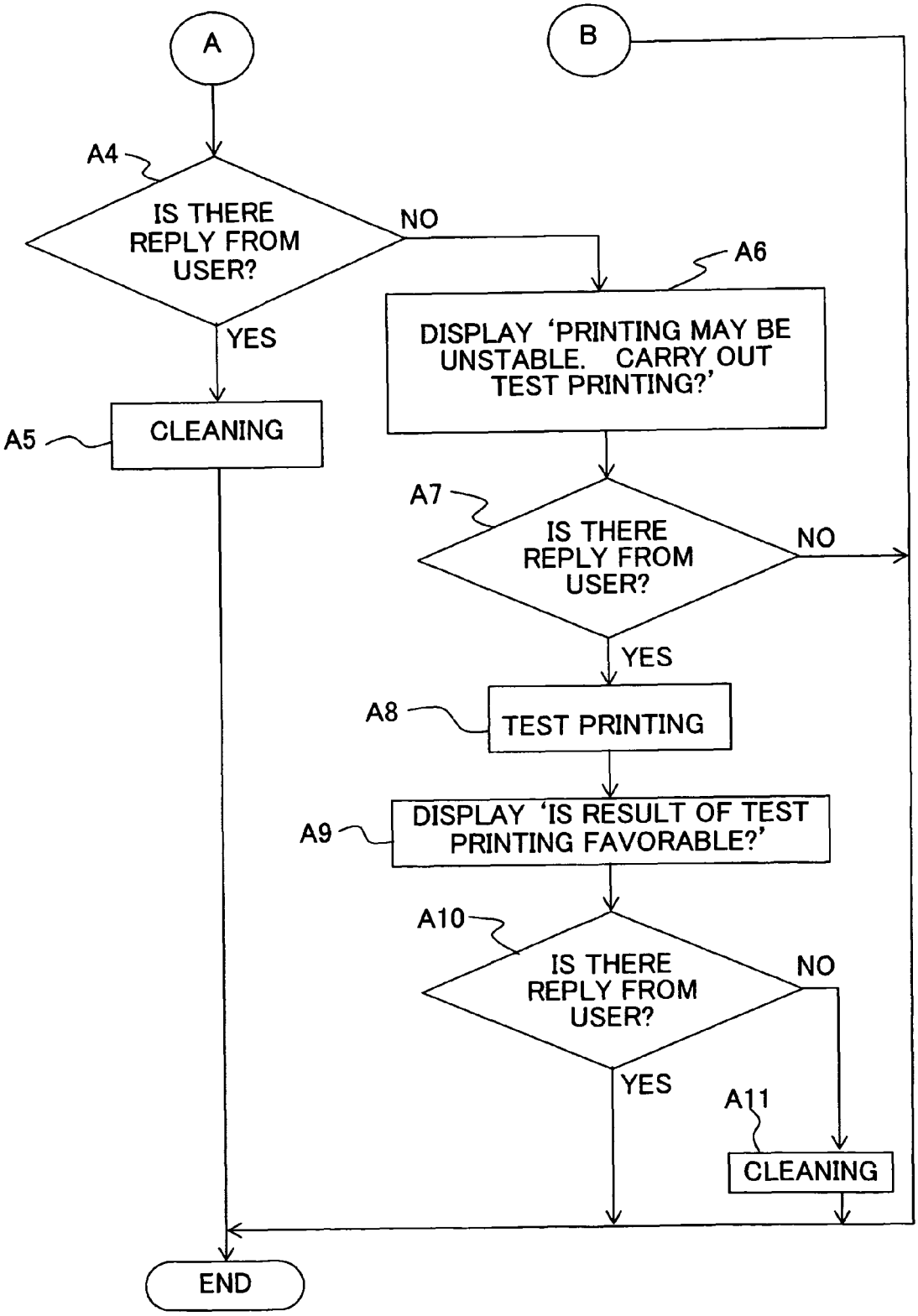

As shown in FIG. 6, firstly, when the power supply is switched ON (step A1), an operation status of the time measuring section 68 is checked (step A2). Here, by reading the elapsed time which has been measured, it is possible to check the operation status of the time measuring section 68. Or, the operation status of the time measuring section 68 may be checked by checking whether the battery is depleted. When the battery is mounted in the printer, and the operation of the time measuring section 68 is continued even when the power supply of the printer is OFF, a judgment that the measurement of the elapsed time by the time measuring section 68 is possible (has been carried out) is made (Yes at step A2). At this time, even after the power supply of the printer is switched ON, based on the time measured by the time measuring section 68, the recovery operation control section 63, drives the flushing control section 62, the purge control section 64, and the air discharge section 65 at a predetermined cycle respectively.

Figure 2B:
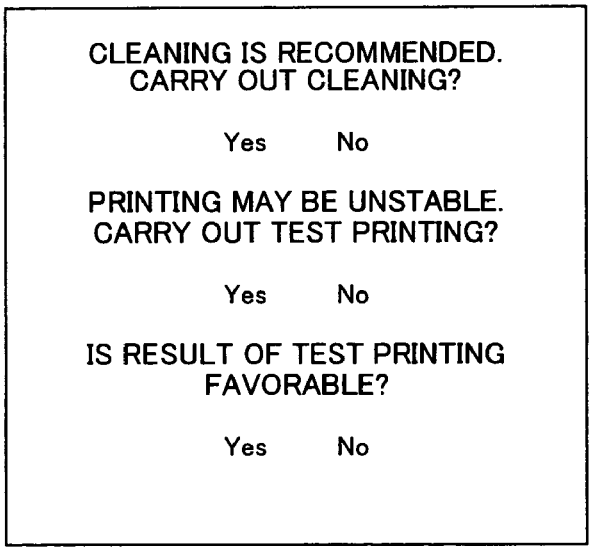

On the other hand, when the battery has been depleted, or when the battery has not been installed in the apparatus, the operation of the time measuring section 68 is stopped, and the time elapsed after the previous recovery operation has not been known (is unknown) (No at step A2). In this case (No at step A2), the display control section 66, displays on the display section 92 a message 'Cleaning has been recommended. Would you like to carry out cleaning?' as shown in FIG. 2B (step A3). Accordingly, the display control section 66 asks the user, whether or not to carry out the cleaning operation.

When the user inputs 'Yes' signal from the input section 91 seeking to carry out the cleaning operation (Yes at step A4), the recovery operation control section 63 makes the purge control section 64 and the air discharge control section 65 carry out the suction purge operation and the air discharge operation respectively as the cleaning operation (step A5). Concretely, the purge control section 64 and the air discharge control section 65 connect the air discharge cap 8 and the air discharge channels 7*a* to 7*d*, and cover the nozzles 25 by the purge cap 10. Further, (the purge control section 64 and the air discharge control section 65) connect the air discharge cap 8 and the suction pump 12 by the switching unit 11, and discharge the air accumulated in an upper portion of the ink tanks 5*a* to 5*d*. Thereafter, the purge cap 10 and the suction pump 12 are connected by the switching unit 11. Further, the suction purge operation of sucking the ink from the nozzle 25 and discharging is carried out.

When the user inputs 'No' signal from the input section 91 seeking not to carry out the cleaning operation (No at step A4), a message 'There is possibility that printing is unstable. Would you like to carry out test printing?' is displayed on the display section 92 (step A6), and asks the user whether or not the test printing is to be carried out. When the user inputs 'No' signal for not carrying out the test printing from the input section 91 of the PC (operation panel section) 90 (No at step A7), the current sequence is terminated without carrying out the test printing.

When the user inputs 'Yes' signal seeking to carry out the test printing, from the input section 91, the recording (image forming) control section 61 controls the ink-jet head 4, the main scanning unit, and the transporting unit, and performs the test printing of forming a predetermined image pattern on the paper (step A8). Moreover, the recording (image forming) control section 61 displays a message 'Is result of test printing favorable?' on the display section 92, and asks the result of test printing to the user (step A9). When the user makes a judgment that the result of the test printing is favorable, and inputs 'Yes' signal from the input section 91 (Yes at step A10), the current sequence is terminated without carrying out the cleaning operation. When the user makes a judgment that the result of the test printing is not favorable and inputs 'No' signal (No at step A10), the recovery operation control section 63 makes the purge control section 64 and the air discharge control section 65 carry out the cleaning operation similarly as in step A5 (step A11).

According to the ink-jet printer 1 according to the first embodiment described above, after it has become impossible to measure the elapsed time by the time measuring section 68 due to the power supply being OFF, when the power supply is switched ON, the controller 60 displays a message of whether or not the cleaning operation is to be carried out on the display section 92. By displaying the message, the user is able to select by own will whether the cleaning operation is to be carried out. When a system environment is such that the power supply is switched ON and OFF frequently, and when the time for which the time could not be measured by the time measuring means is short due to a reason such that the power supply is switched OFF temporarily for moving the printer, normally it is not necessary to carry out the cleaning operation. Since the user is capable of selecting at own will, as to whether the cleaning operation is to be carried, in such case, it is possible to make an arrangement such that the cleaning operation is not carried out.

Moreover, since the cleaning operation is carried out only when it has been sought by the user from the input section 91, it is possible to solve problems such as a waiting time for the unnecessary cleaning operation, and a wasteful consumption of ink.

Second Embodiment

Next, an ink-jet printer according to a second embodiment of the present invention will be described below by referring to FIG. 7. In the second embodiment, the cleaning operation is to be carried out according to the number of days for which the power supply is OFF. The main body portion of the ink jet printer in FIG. 1 to FIG. 4, and the block diagram in FIG. 5 are similar (even for the second embodiment).

Figure 2C:
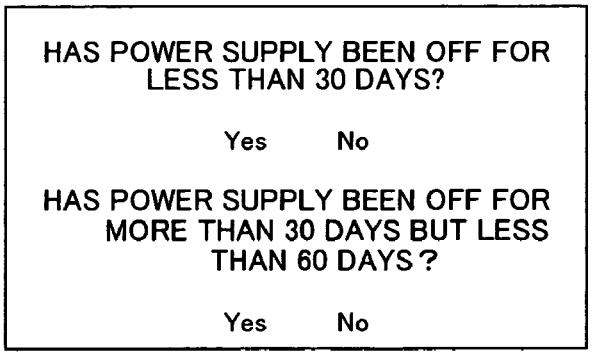
Figure 7A:
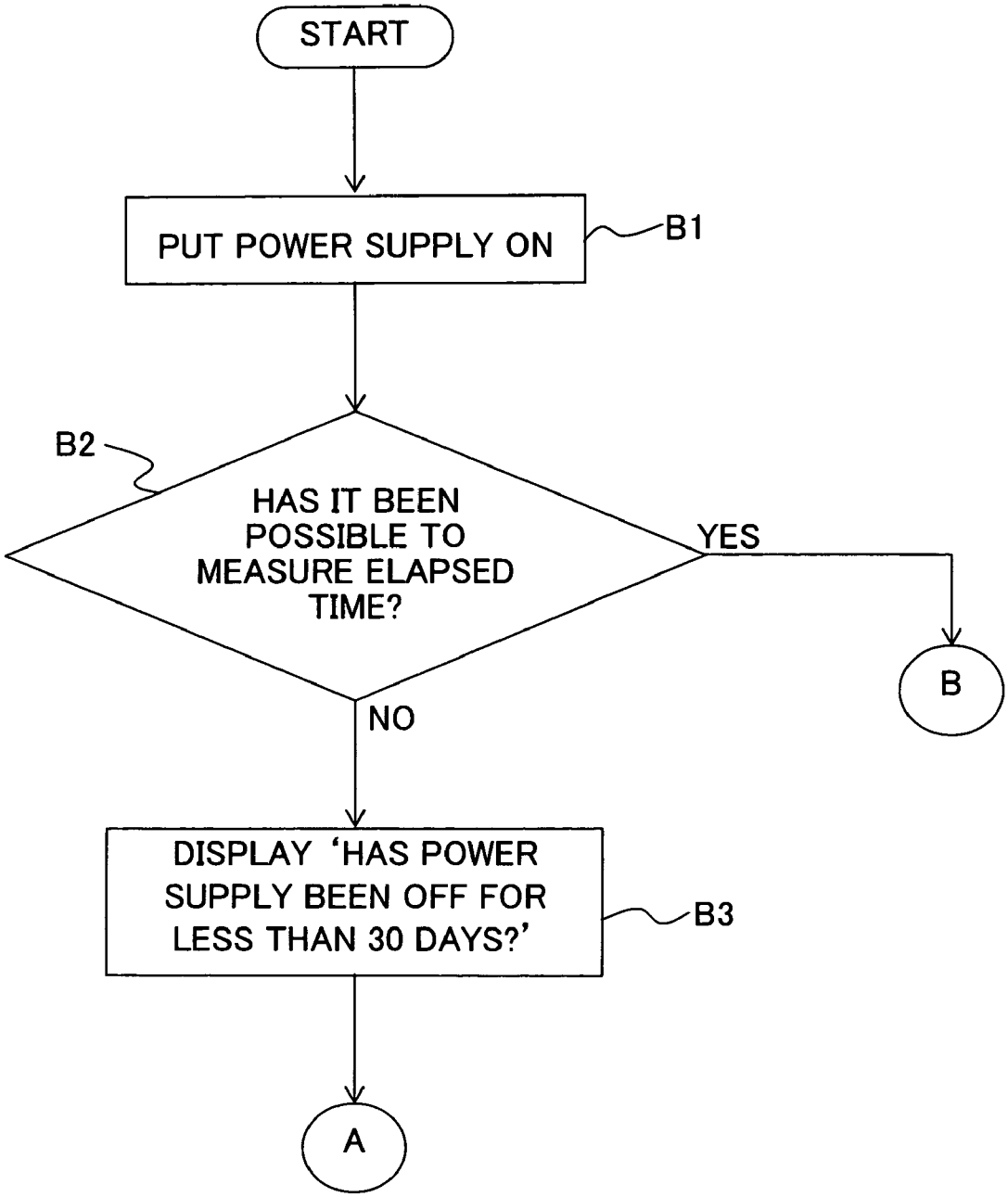
FIGS. 7A and 7B are flowcharts describing a cleaning operation of a second embodiment.
Figure 7B:
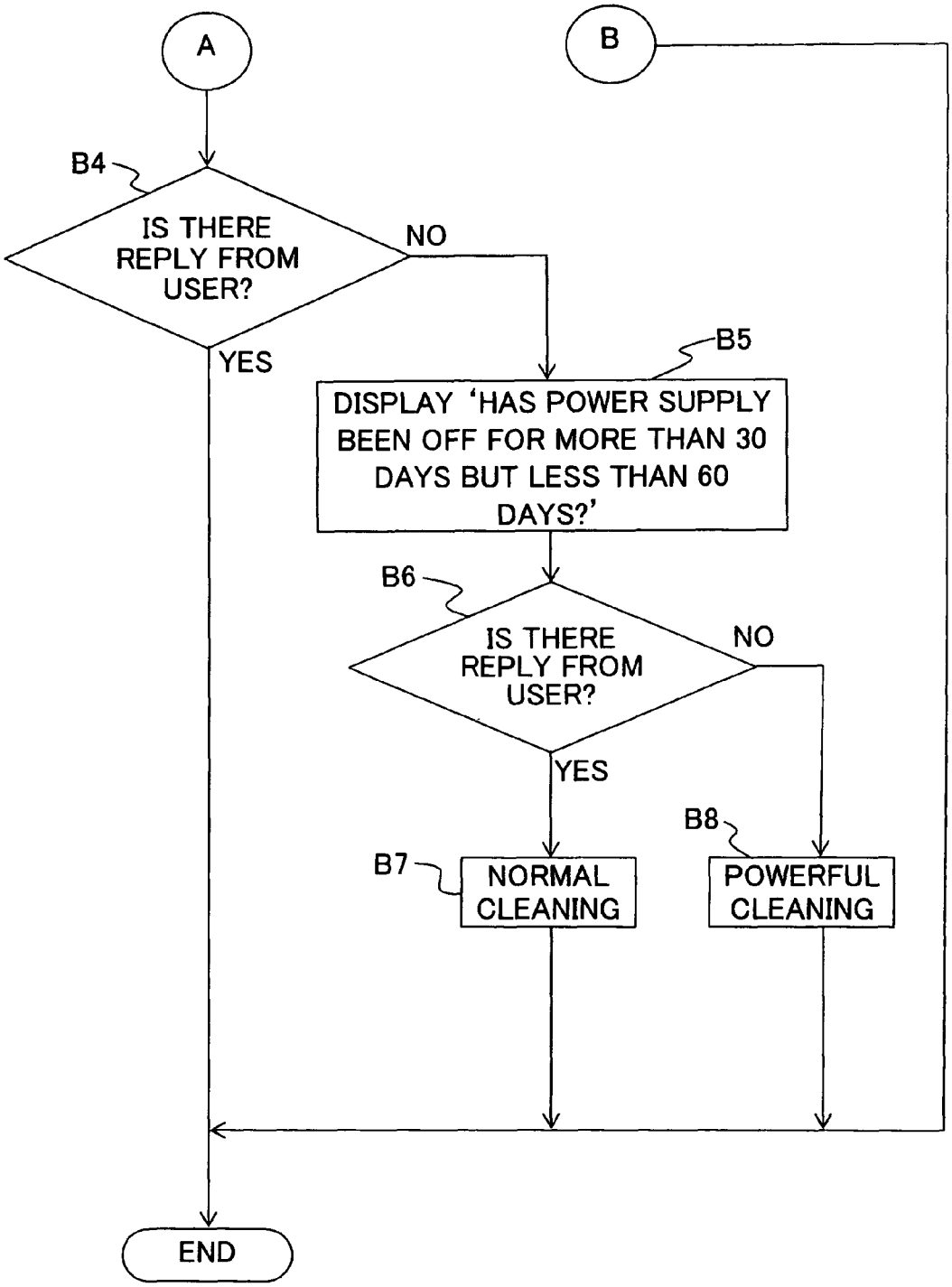

As shown in FIG. 7, firstly, when the power supply is switched ON (step B1), the operation status of the time measuring section 68 is checked (step B2). Steps up to here being same as steps A1 and A2, the description thereof in detail is omitted. On the other hand, when the time elapsed after the previous recovery operation is unknown (No at step B2), a message 'Has power supply been OFF for less than 30 days?' as shown in FIG. 2C is displayed on the display section 92 (step B3). In this manner, the number of days for which the power supply has been OFF, in other words, the time elapsed since the power supply has been switched OFF is asked to the user.

When the user inputs 'Yes' signal from the input section 91 (Yes at step B4), the current sequence is terminated without carrying out the cleaning operation. When the user inputs 'No' signal from the input section 91 (No at step B4), a message 'Has power supply been OFF for more than 30 days but less than 60 days?' is displayed on the display section 92 (step B5), and asks the user the number of days for which the power supply has been OFF.

When the user inputs 'Yes' signal from the input section 91 (Yes at step B6), the recovery operation control section 63 makes the purge control section 64 and the air discharge control section 65 carry out the cleaning operation (step B7), and the content of the cleaning operation is same as in the steps A5 and A11 in the first embodiment. When the user inputs 'No' signal from the input section 91 (No at step B6), the recovery operation control section 63 makes the purge control section 64 and the air discharge control section 65 carry out a powerful (intensive) cleaning operation (step B8). At this time, in the powerful cleaning operation carried out at step B8, the number of days for which the power supply has been OFF being large (more), an amount of suction by the suction purge and the air discharge purge is increased as compared to the amount of suction in the cleaning operation carried out at step B7.

It is possible to display a message 'Input number of days for which the power supply was OFF' instead of the above-mentioned message, and to input the number of days from the input section 91 by the user, and to control the presence or absence (execution) and the magnitude (the degree) of the jetting function recovery operation based on the magnitude of the figure (number of days).

According to the ink-jet printer 1 of the second embodiment as described above, when the power supply is switched ON after the measuring of the elapsed time by the time measuring section 68 becomes impossible due to the power supply of the printer being switched OFF, the controller 60 makes display a message asking the user a period for which the power supply was OFF. Accordingly, the controller 60 is capable of finding as to approximately how much time has elapsed after the power supply was switched OFF, and based on this time, it is possible to control the cleaning operation by the recovery operation control section 63.

Moreover, by not carrying out the cleaning operation when the period for which the power supply was OFF, it is possible to do away with the dissatisfaction of the user that the unnecessary cleaning operation is carried out (that the cleaning operation is carried out unnecessarily).

Furthermore, by changing the degree (intensity) of cleaning according to a length of the period for which the power supply was OFF, it is possible to recover the jetting function of the ink-jet head irrespective of the drying of ink.

In the first embodiment and the second embodiment, when the user has switched the power supply ON for the first time after purchasing the ink-jet printer, it is preferable to make a setting to carry out a suction operation for infusing the ink to the ink-jet head from the ink cartridge based on a detection of installation of the new ink cartridge, without carrying out the abovementioned control.

Moreover, it is also possible to make an arrangement such that, in a state in which the power supply is ON continuously, based on the measurement of time by the time measuring section 68, the controller 60 not only performs the jetting function automatically, but also when it has reached a time at which the jetting function recovery operation is to be carried out, or when it's close to the time at which the jetting function recovery operation is to be carried out, the display section 92 displays it as a message, and the jetting function recovery operation is carried out when the user has given an instruction from the input section 91.

Exemplary embodiments of the present invention have been described above. However, the present invention is not restricted to the embodiments described above, and various modifications which fairly fall within the basic teaching herein set forth are possible. For instance, it is also possible to make an arrangement in which, a set of an ink-jet printer and a personal computer are let to be an image forming apparatus, and the input section 91 and the display section 92 are substituted by a display and an input device such as a key board of a personal computer.

Moreover, in the first embodiment and the second embodiment, as the cleaning operation, the suction purge operation and the air discharge operation are carried out. However, the flushing operation may be included in the cleaning operation, and these operations may be carried out separately, or these operations may be carried out in combination arbitrarily. Furthermore, in the first embodiment and the second embodiment, the air discharge operation and the purge operation have been carried out by the suction pump. However, an arrangement may be made such that, a positive pressure is applied to the ink from a side of the ink cartridges 14*a* to 14*d*, and the air discharge operation of pushing the air from the ink tanks 5*a* to 5*d* is carried out with the valve 17 open, and the purge operation of pushing the ink from the nozzles 25 is carried out with the valve 17 closed.

In the first embodiment, after the cleaning operation has been recommended, the cleaning operation is carried out upon making the user select whether (the cleaning operation is) to be executed. However, the cleaning operation is not required to be carried out necessarily, and only the user's attention may be called to carry out the cleaning operation.

In the second embodiment, the degree (intensity) of the cleaning operation by the recovery operation control section 63 has been changed according to the degree (length) of the period input from the input section 91. However, the degree (intensity) of the cleaning operation may be changed according to the user's judgment, and the degree (intensity) of the cleaning operation may be the same irrespective of the degree (length) of the period.

Moreover, it is also possible to execute both the embodiments (the first embodiment and the second embodiment) in combination such as by displaying the message 'Has power supply been OFF for less than 30 days' at step B3 in the second embodiment after displaying the message 'Cleaning has been recommended. Would you like to carry out cleaning?' at step A4 in the first embodiment.

In the embodiments described above, the image forming apparatus has the time measuring section as the information retention mechanism. After the power supply of the image forming apparatus has been switched OFF, when the time measuring section cannot continue (fails to continue) to measure the time due to depletion of the battery, a message asking the necessity of the recovery operation is displayed for the user. However, the information retention mechanism used in the image forming apparatus of the present invention may not necessarily have a timer function such as a time measuring section. For example, the image forming mechanism (apparatus) may have an information retention mechanism such as a counter and a memory which retains various history information, and when the power supply of the image forming apparatus is switched ON, in a case of occurrence of any error in reading the information retained (stored) in the information retention mechanism, the message asking the necessity of the recovery operation may be displayed for the user as described above. Concretely, history information such as a size of printing data, number of jettings (number of dots) of ink droplets, the number of printing (images printed), a frequency of replacement of ink cartridge, and/or a frequency of paper jamming is retained in the information retention mechanism. At this time (In this case), when the power supply of the image forming apparatus is switched ON, and in a case in which, it is not possible to acquire this information retained in the information retention mechanism, or this information has an abnormal value distinctly, the message asking the necessity of the recovery operation may be displayed for the user as described above.

In the embodiments described above, the image forming apparatus has the display section (display mechanism) which displays a message for the user, and the input section (input mechanism) which inputs a reply (response) from the user. However, the image forming apparatus of the present invention is not restricted to this, and may have one of the display section and the input section, or may have both the display section and the input section. For example, a display such as a liquid-crystal display and/or an input device such as a key switch may be provided independently of the image forming apparatus. Even in such a case, the control mechanism of the image forming apparatus may be capable of sending and receiving a predetermined signal to and from the input device and/or the display (a signal such as a signal for displaying a message on the display and a signal for receiving a reply (response) from the user).

Furthermore, in the first embodiment and the second embodiment, examples in which the image forming apparatus of the present invention is applied to the ink-jet printer are shown. However, the present invention is also applicable to an apparatus such as an apparatus which manufactures a color filter of a liquid crystal display apparatus by applying a colorant in a predetermined pattern, and an apparatus which forms a wiring pattern of an electronic circuit by applying an electroconductive liquid in the wire form.

In the first embodiment and the second embodiment described above, the image forming apparatus has the controller, and the controller displays a message on the display section, and controls the recovery operation for the ink-jet head. However, even when it is an image forming apparatus which does not have the abovementioned controller, by the image forming apparatus being connected to a computer, it is possible that the computer performs various controls which are carried out by the controller in the first embodiment and the second embodiment described above. In that case, the computer may run (execute) a computer program which executes various controls which are carried out by the controller described above.

What is claimed is:

1. An image forming apparatus which is connected to a predetermined display and a predetermined input device, and which performs formation of an image by jetting liquid droplets onto a medium, the image forming apparatus comprising:

a liquid droplet jetting head which jets the liquid droplets;

a recovery mechanism which recovers a liquid droplet-jetting function, of the liquid droplet jetting head, of jetting the liquid droplets; and a control mechanism which controls the recovery mechanism based on the predetermined history information retained in an information retention mechanism, and which is connected to the display and the input device;

wherein, when a power supply of the image forming apparatus is switched ON and when there is an abnormality in the history information, the control mechanism outputs to the display a signal which causes a predetermined message to be displayed on the display.

2. The image forming apparatus according to claim 1;

wherein the information retention mechanism has a timer which measures time; and wherein the abnormality in the history information is a state that the timer is not capable of measuring the time; and wherein the predetermined message is a message asking a user whether or not an operation for recovering the jetting function recovery operation by the recovery mechanism is to be performed.

3. The image forming apparatus according to claim 2;

wherein when a signal requesting the operation for recovering the jetting function is inputted from the input device, the control mechanism makes the recovery mechanism recover the jetting function.

4. The image forming apparatus according to claim 1;

wherein the information retention mechanism has a timer which measures time; and wherein the abnormality in the history information is a state that the timer is not capable of measuring the time; and wherein the predetermined message is a message asking a user about a duration of time during which the power supply has been switched OFF.

5. The image forming apparatus according to claim 4;

wherein the control mechanism makes a judgment of whether or not the operation for recovering the jetting function by the recovery mechanism is to be performed, based on an extent, of the duration of period, inputted from the input device.

6. The image forming apparatus according to claim 4;

wherein the control mechanism changes an intensity of the operation for recovering the jetting function by the recovery mechanism, based on the duration of period inputted from the input device.

7. The image forming apparatus according to claim 1, further comprising:

a display section as the display; and an input section as the input device.

8. The image forming apparatus according to claim 1;

wherein the information retention mechanism has a counter which retains information about a number of the liquid droplets jetted from the liquid droplet jetting head.

9. The image forming apparatus according to claim 1;

wherein the information retention mechanism has a counter which retains information about a number of the medium on which the image is formed by the liquid droplet jetting head.

10. The image forming apparatus according to claim 1;

wherein the abnormality in the history information is a state selected in a group consisting of:

a state in which a printing data for the liquid droplet jetting head is an abnormal value;

a state in which a number of jetting of the ink droplets is an abnormal value;

a state in which a frequency of replacement of ink cartridge is an abnormal value;

a state in which a frequency of paper jamming is an abnormal value; and a state in which a timer that is provided with the information retention mechanism is not capable of measuring a time.

11. A non-volatile information recording medium which is readable by a computer, comprising:

a computer program recorded on the information recording medium;

wherein the computer program causes the computer to:

make a judgment with respect to an image forming apparatus connected to a predetermined display and a predetermined input device, performing formation of an image formation by jetting liquid droplets onto a medium, the image forming apparatus including:

a liquid droplet jetting head which jets the liquid droplet; and a recovery mechanism which recovers a liquid droplet-jetting function, of the liquid droplet jetting head, of jetting the liquid droplets;

wherein the judgment is about whether or not there is an abnormality in predetermined history information retained by an information retention mechanism when a power supply of the image forming apparatus is switched ON;

cause a predetermined message to be displayed on the display when a judgment is made that there is the abnormality in the history information; and cause the recovery mechanism to recover the liquid droplet-jetting function of the liquid droplet jetting head based on a response, to the message, inputted from the input device.

12. The information recording medium according to claim 11;

wherein the information retention mechanism has a timer which measures a time; and wherein the abnormality in the history information is an inability of the timer to measure the time; and wherein the predetermined message is a message for asking a user whether or not an operation for recovering the jetting function by the recovery mechanism is to be performed.

13. The information recording medium according to claim 11;

wherein the information retention mechanism has a timer which measures a time; and wherein the abnormality in the history information is an inability of the timer to measure the time, and the predetermined message is a message for asking a user about a duration of time during which the power supply had been switched OFF.

14. The information recording medium according to claim 11;

wherein the abnormality in the history information is a state selected in a group consisting of:

a state in which a printing data for the liquid droplet jetting head is an abnormal value;

a state in which a number of jetting of the ink droplets is an abnormal value;

a state in which a frequency of replacement of ink cartridge is an abnormal value;

a state in which a frequency of paper jamming is an abnormal value; and a state in which a timer that is provided with the information retention mechanism is not capable of measuring a time.

* * * * *